United States Patent [19]

Abys et al.

[11] Patent Number: 4,493,754

[45] Date of Patent: Jan. 15, 1985

[54] ELECTRODES FOR PALLADIUM ELECTROPLATING PROCESS

[75] Inventors: Joseph A. Abys, Bridgewater; Yutaka Okinaka, Madison, both of N.J.

[73] Assignee: AT&T Bell Laboratories, Murray Hill, N.J.

[21] Appl. No.: 567,348

[22] Filed: Dec. 30, 1983

[51] Int. Cl.[3] ..... C25D 3/52

[52] U.S. Cl. ..... 204/47

[58] Field of Search ..... 204/47, 109

[56] References Cited

U.S. PATENT DOCUMENTS 4,401,527 8/1983 Duva et al. ..... 204/47

OTHER PUBLICATIONS

S. Wakabayashi et al., J. de Physique, Colloque Cl, No. 4, 38, p. Cl-241, Apr. 1977.

"Development of Ferrite and New Metal Anode", *New Materials & New Processes,* vol. 2, (1983), K. Ohe et al., pp. 404–412.

"Ferrite Electrodes", *New Materials & New Processes,* vol. 2, (1983), I. Yokoyama et al., pp. 462–470.

*Primary Examiner*—G. L. Kaplan

*Attorney, Agent, or Firm*—Walter G. Nilsen

[57] ABSTRACT

A palladium electroplating process is described in which certain unique anode structures are used. These anodes have surfaces made of conducting ferrites such as nickel ferrite. Such anodes have low oxygen overvoltage, high chemical stability and minimum decomposition of complexing agent in the palladium electroplating bath.

8 Claims, 2 Drawing Figures

ELECTRODES FOR PALLADIUM ELECTROPLATING PROCESS

TECHNICAL FIELD

The invention is a process for electroplating palladium. In particular, it is directed to the use of certain types of anodes in palladium electroplating processes.

BACKGROUND OF THE INVENTION

Palladium is used in a variety of applications both because of its pleasing luster and excellent electrical properties and its lower cost compared to gold and platinum. In particular, it is used extensively as an electrical contact material because of its chemical stability and the fact that an insulating layer is not formed on the surface. Indeed, because of the lower cost of palladium compared to gold, palladium has partially replaced gold as a high quality electrical contact material.

Palladium is electroplated by a variety of processes usually involving a complexing agent such as ammonia, organic amine, aliphatic polyamine, etc. It is highly desirable that those complexing agents remain stable in the palladium electroplating process so as to ensure long life for the plating bath.

SUMMARY OF THE INVENTION

The invention is a palladium electroplating process in which the anode or counter-electrode has a surface comprising one or more ferrites. Typical ferrites are nickel ferrite ($NiFe_2O_4$), cobalt ferrite ($CoF_2O_4$), manganese ferrite ($MnFe_2O_4$) and zinc ferrite ($ZnFe_2O_4$). Preferred is nickel ferrite because of the low anode potentials, stability and long lifetime. Use of such anodes reduces decomposition of complexing agent in the palladium bath and increases bath lifetime.

DETAILED DESCRIPTION

Figure 2:
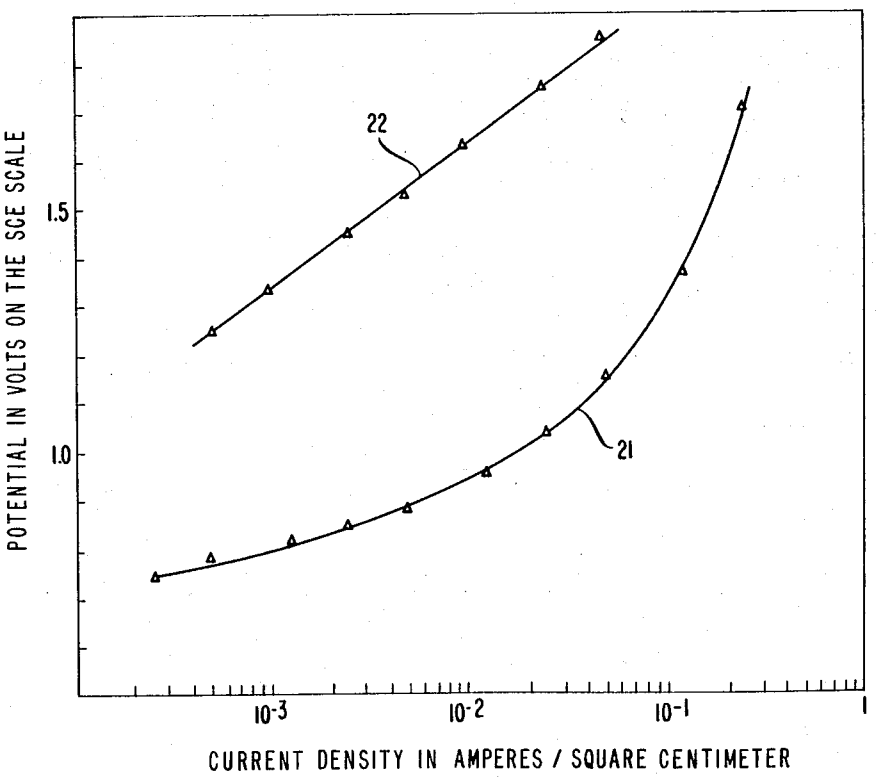
FIG. 2 shows data in the form of a graph of potential versus current density for a ferrite anode and a platinum anode.

The invention arises from a discovery that the use of certain ferrite anodes in electroplating palladium from alkaline plating baths yields greatly reduced anode overvoltages. This reduction in potential is highly advantageous because it drastically reduces the amount of decomposition of components of a plating bath. This leads to significantly longer lifetimes for the plating bath, fewer interruptions in the plating procedure, and a more constant composition for the palladium electroplating process.

The development and use of ferrite electrodes has been discussed in a number of references including a scientific paper by K. Ohe and S. Saito, "Developments of Ferrites and New Metal Anodes" in Volume 2 of *New Materials and New Processes,* Jec Press, Incorporated, 1983, pp. 404–412 and an article by I. Yokoyama and Y. Kaneko, "Ferrite Anodes" in the same volume, pp. 462–470. The bath composition is more or less conventional using generally alkaline compositions and some sort of complexing agent to ensure high solubility and stability for the source of palladium. Some typical bath compositions will be given below.

The particular procedure for making the electrode is not critical provided the surface of the anode comprises a conducting ferrite. The entire electrode may be made of ferrites, as for example, in the form of a pressed polycrystalline material or polycrystalline material attached to a conducting substrate. Typical conducting substrates are titanium, niobium, tantalum, aluminum, steel, and various inert metallic materials such as platinum, gold, and iridium.

Generally, a thick layer of ferrite is used. This may be made by conventional means, including mixing the relevant oxides, heating and pressing at the appropriate temperature range. Other procedures involve spraying onto a hot electrode substrate a solution of the proper ions in the proper composition and heat treating to convert to the oxide and to the ferrite. For example, a solution of ferric chloride and nickel chloride might be used to make nickel ferrite.

A variety of bath chemistries may be used in the practice of the invention. Generally, the bath should contain a source of palladium and be sufficiently conducting to permit reasonable electroplating rates (at least $10^{-3}$ mho-cm). Typical are ammonia-based plating solutions often with palladium complexed with ammonia, but other types of palladium plating solutions are also useful. Some typical solutions are given below.

| | | |
|---|---|---|
| 1. | $Pd(NH_3)_4Cl_2$ | |
| | $NH_4Cl$ | |
| | Sufficient ammonia to a pH of 9–10, 9.4 most preferred. | |

The amount of palladium salt should be at least 10 gm/l in terms of palladium metal. Higher concentrations are often preferred, say at least 20 gm/l or even 100 gm/l.

| | | |
|---|---|---|
| 2. | $Pd(NH_3)_2(NO_2)_2$ | 4 g Pd/l |
| | $NH_4NO_3$ (optional) | 90 gm/l |
| | $NaNO_2$ (optional) | 11.3 gm/l |
| | Ammonia to pH between 8 and 10, with 9.0 most preferred. | |
| 3. | $Pd(NH_3)_4(NO_3)_2$ | |
| | Salts to stabilize the complex and increase conductivity. | |
| | pH = 7–10 by the addition of alkaline agent such as ammonia. | |
| 4. | $Pd(NH_3)_2Cl_2$ | 10 gm/l to saturation |
| | $NH_4Cl$ | 65 to 250 gm/l |
| | pH adjusted by the addition of ammonia to 8.0–9.2 with 8.8 most preferred. | |

Although ammonia complexing agents do not usually decompose at the anode, other organic additives do decompose and use of the disclosed ferrite anodes reduces or eliminates such decomposition.

For many applications, a high concentration of the palladium salt is preferred with or without the conducting salts, provided such a bath is stable.

Other palladium complexes are also useful as plating baths in the practice of the invention. The palladium complex $Pd(NH_3)_4Br_2$ is used as the basis for some palladium plating baths. Useful concentrations in terms of palladium metal are from 2 g/l to saturation (about 35 g/l). The pH range is from 9 to 10 with the range from 9 to 9.5 preferred. Other palladium complexes such as the corresponding sulfate, phosphate, tartate, citrate oxalate and carbonate also may be useful.

The double nitrite salts of palladium are also useful for palladium plating. A typical salt is $K_2Pd(NO_2)_4 \cdot 2H_2O$. Other similar salts (i.e., potassium replaced by another alkali metal such as sodium, lithium, etc.) may also be used.

Another typical palladium bath contains a palladium solution complexed with ethylenediamine or other complexing agent. Typically, the palladium is added as $PdCl_2$ and sulfate as an alkali-metal sulfate $Na_2SO_4$). Sufficient complexing agent (i.e., ethylenediamine) is added to dissolve the palladium chloride. Typical concentrations are 28 g/l $PdCl_2$ and 140 g/l $NaSO_4$. Increased concentration of palladium compound is desirable up to the saturation concentration of the palladium complex. The pH may vary over wide limits (i.e., 10–13) but is usually between 11 and 12.

The simple salt $PdCl_2$ is also useful in plating baths in the practice of the invention. Typically, the bath comprises $PdCl_2$, ammonium chloride and a strong acid (generally aqueous HCl) to a pH from 0.1 to 0.5. Typical concentration of $PdCl_2$ is 52 g/l to saturation and 22–38 g/l $NH_4Cl$. Plating temperature to 50 degrees C. is usually used.

Although the source of palladium described above may be used with a great variety of palladium electroplating baths, it is most useful when used with a bath where palladium is complexed with an aliphatic polyamine. Particularly advantageous is an aliphatic polyamine with 3–20 carbon atoms, especially aliphatic diamines with 3–10 carbon atoms. These baths are most preferred because of the excellent plating results obtained and compatibility with the palladium source palladium-1,3-diaminopropanedichloride. More than one aliphatic polyamine may be used in the bath. Typical complexing agents are diaminopropane (particularly 1,3-diaminopropane), diethylenetriamine, 1,4-diaminobutane, 1,6-diaminohexane, etc. Secondary polyamines such as N,N'-dimethyl-1,3-propanediamine and tertiary polyamines such as N,N,N',N'-tetramethylethylenediamine are also useful provided the total number of carbon atoms does not exceed 20. A limited number of substitutents is also useful, such as hydroxy groups (i.e., 2-hydroxy-1,3-diaminopropane) and halogen groups such as chloride and bromide. The complexing agent 1,3-diaminopropane is most preferred because of excellent plating results especially at high plating rates. It is preferred that the aqueous electroplating bath be alkaline (pH greater than 7.0) to avoid corrosion of the surface being plated and sufficiently conductive to allow plating (generally greater than $10^{-3}$ mho-cm). Additional substances may be added to the palladium plating bath to control and adjust pH (such as a buffer), to increase conductivity and to improve the properties of the plated metal. Typical substances used to improve the plated metal are lactones (i.e., phenolphthalein, phenolsulfonephthalein, etc.), lactams, cyclic sulfate esters, cyclic imides and cyclic oxazolines. Certain polyalkoxylated alkylphenols may also be useful. The process is also useful for plating certain palladium alloys including 10 mole percent palladium, remainder copper, nickel and/or silver.

There are a number of advantages associated with use of organic aliphatic polyamines as complexing agents in palladium electroplating processes. First, the conditions (particularly pH, corrosivity) are much improved so that chemical attack on the surface being plated is much reduced or eliminated. Second, production of hydrogen is eliminated even at high plating rates (even above 200 or even 500 ASF). Third, the quality of plating is much improved even at very high plating rates. The pH of the bath may vary over large limits, but generally alkaline aqueous solution is preferred (typically pH from 7.5 to 13.5) with the range from 9.0 to 12.5 preferred, and 11.0 to 12.5 most preferred. The preference particularly applies when the preferred polyamines are used, namely organic aliphatic diamines with 3 to 10 carbon atoms and most particularly 1,3-diaminopropane. Within the pH range, very rapid plating can be carried out with excellent plating results. Generally, a bath composition which permits rapid plating with more alkaline solution is preferred because of decreased attack on the surface being plated and decreased chances of hydrogen evolution.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH, NaOH, etc.) to an aqueous solution of the hydrogen phosphate ion. Generally, the concentration of buffer varies from about 0.1 molar to 2 molar (about $1.0 \pm 0.2$ molar preferred) and the mole ratio of hydrogen phosphate to phosphate varies from 5/1 to 1/5 (with equal mole amounts within $\pm 50$ percent preferred). These mole ratios often depend on the particular pH desired for the plating bath.

The bath temperature may vary over large limits, typically from the freezing point to the boiling point of the electroplating bath. Often, the preferred plating temperature range depends on bath composition and concentration, plating cell design, pH and plating rate. Preferred temperatures for typical conditions are from room temperature to about 80 degrees C. with 40 to 60 degrees C. most preferred.

Various surfaces may be plated using the disclosed process. Usually, the plating would be carried out on a metal surface or alloy surface, but any conducting surface would appear sufficient. Also, electrolessly plated surfaces may be useful. Typical metal and alloy surfaces are copper, nickel, gold, platinum, palladium, (as, for example, a surface electrolessly plated with palladium and then electroplated with palladium in accordance with the invention). Various alloy surfaces may also be used such as copper-nickel-tin alloy, other copper alloys such as beryllium-copper, etc.

The composition of the bath may vary over large limits provided it contains a source of palladium and significant amounts of one or more polyamines of the class set forth above. In general, sufficient polyamine should be present to complex with the palladium. Usually, it is advantageous if excess polyamine is present in the bath solution.

The palladium concentration in the bath typically varies from 0.01 molar to saturation. Preferred concentrations often depend on plating rate, cell geometry, agitation, etc. Typical preferred palladium concentration ranges for high-speed plating (50 to 1000 ASF) are higher than for low-speed plating (up to 50 ASF). Preferred palladium concentration ranges for high-speed plating vary from 0.1 to 1.0 molar. For low-speed plating, the preferred range is from 0.05 to 0.2 molar. Where palladium alloy plating is included, the alloy metal (usually copper, silver or nickel) replaces part of the palladium in the composition of the plating bath.

Typically, up to 90 mole percent of palladium may be replaced by alloy metal.

The amount of complexing agent (polyamine) may vary over large limits, typically from 0.5 times (on the basis of moles) the concentration of the palladium species to saturation of the complexing agent. Generally, it is preferred to have excess complexing agent, typically from 2 times to 12 times the mole concentration of the palladium species. Most preferred is about 6 times the mole concentration of palladium. The preferred ranges of complexing agent in terms of palladium species are the same for high-speed and low-speed baths.

The concentration of buffer may vary over large limits. Such concentrations often depend on cell design, plating rates, etc. Typically, the buffer concentration varies from 0.1 molar to saturation with from 0.2 to 2.0 molar preferred.

Figure 1:
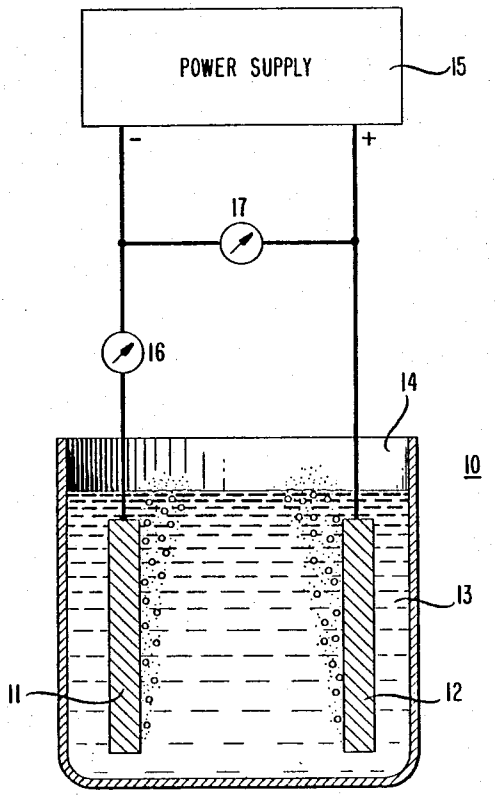
FIG. 1 shows a typical apparatus for practicing the invention.

FIG. 1 shows an apparatus 10 useful for the practice of the invention. The apparatus shows a cathode 11 and anode 12 made in accordance with the invention. Also shown is the electroplating bath 13 containing a source of palladium and complexing agent for palladium (e.g., 1,3-diaminopropane). The electrodes and bath are enclosed in a container 14. The electroplating reaction is driven by a source of electrical power 15 (generally an electronic power supply) and the reaction monitored with a voltmeter 17 and ammeter 16.

FIG. 2 shows data on two electrodes, one platinum 22 and the other ferrite 21 (nickel ferrite) in a solution containing 0.5 molar 1,3-diaminopropane in water. The pH of the solution was 11.52 and the parameter measured was the potential (against an SCE standard cell) as a function of current density at the electrode. Lower voltages not only save power but minimize undesirable side reactions at the anode such as decomposition of complexing agent.

What is claimed is:

1. A process for electroplating palladium comprising the step of passing current through an anode, plating solution and cathode, said plating solution comprising a source of palladium and complexing agent said complexing agent consisting essentially of at least one aliphatic polyamine with up to 20 carbon atoms characterized in that the surface of the anode comprises 8 ferrite.

2. The process of claim 1 in which the ferrite is selected from the group consisting of nickel ferrite, zinc ferrite, manganese ferrite and cobalt ferrite.

3. The process of claim 2 in which the ferrite is nickel ferrite.

4. The process of claim 1 in which the complexing agent is an aliphatic diamine with up to 10 carbon atoms.

5. The process of claim 4 in which the complexing agent is selected from the group consisting of 1,2-diaminopropane, 1,3-diaminopropane, diethylenetriamine, 1,4-diaminobutane, 1,6-diaminohexane, N,N'dimethyl-1,3-propanediamine and N,N,N',N'-tetramethyl-ethylenediamine.

6. The process of claim 5 in which the complexing agent is 1,3-diaminopropane.

7. The process of claim 1 in which the ferrite electrode is made by pressing and heating the appropriate oxides onto a substrate.

8. The process of claim 1 in which the ferrite is made by spraying a solution onto a heated substrate and heat treating to form the ferrite.

* * * * *